United States Patent [19]

Campbell et al.

[11] 4,203,808

[45] May 20, 1980

[54] ELECTROPLATING CATHODES FOR ELECTROCHEMICAL SYNTHESIS

[75] Inventors: Charles R. Campbell; William A. Heckle; Marion J. Mathews, III, all of Pensacola, Fla.

[73] Assignee: Monsanto Company, St. Louis, Mo.

[21] Appl. No.: 705,307

[22] Filed: Jul. 14, 1976

[51] Int. Cl.[2] ..... C25D 5/00; C25D 21/00

[52] U.S. Cl. ..... 204/23; 204/50 R; 204/242

[58] Field of Search ..... 204/23, 24, 25, 26, 204/27, 50 R, 2.1, 73 R, 73 A

[56] References Cited

U.S. PATENT DOCUMENTS

| | | | |
|---|---|---|---|
| 1,565,216 | 12/1925 | Smith | 204/27 X |
| 3,326,721 | 6/1967 | Henderson et al. | 204/2.1 |
| 3,414,491 | 12/1968 | DuRose et al. | 204/49 |
| 3,600,226 | 8/1971 | McHenry | 204/2.1 |
| 3,826,722 | 7/1974 | Accaries et al. | 204/50 R |
| 3,899,351 | 8/1975 | Maurer et al. | 204/2.1 X |

OTHER PUBLICATIONS

J. K. Dennis et al., "Nickel and Chromium Plating", pp. 105–106, (1972).

Frederick A. Lowenheim, "Modern Electroplating", 2nd Edition, pp. 70–72, (1963).

*Primary Examiner*—G. L. Kaplan

*Attorney, Agent, or Firm*—Thomas Y. Awalt, Jr.

[57] ABSTRACT

Packages of undivided electrolytic cells for electrochemical synthesis having a plurality of metal-plated cathodes with corresponding anodes are produced by assembling and permanently fixing the electrodes in substantially parallel-planar relationship as a package and thereafter electroplating the cathodes in package form by applying an electric potential between the anodes and cathodes in an electroplating solution containing the plating metal in complex form, the anodes functioning as non-sacrificial anodes during electroplating. Such electroplating may be accomplished in the electrochemical synthesis cells and may employ the same power application means and controls as the means and controls employed in the electrochemical synthesis.

12 Claims, 3 Drawing Figures

ELECTROPLATING CATHODES FOR ELECTROCHEMICAL SYNTHESIS

BACKGROUND OF THE INVENTION

A. Field of the Invention

The invention relates to the production of electrolytic cells for electrochemical synthesis, and particularly those cells of the undivided variety in which the electrodes are fixed and in substantially parallel-planar relationship in the form of an electrode package and in which the cathodes are metal-plated, the invention being an improvement in the method of production of such cells.

B. The Background of the Invention

Electrolytic cells for electrochemical synthesis are well known. Generally speaking electrochemical synthesis may involve cathodic processes or anodic processes and/or secondary electrolytic processes. Particularly but not exclusively with respect to cathodic processes, and more particularly with respect to the electrochemical reduction of organic compounds, it is common to use metal-plated cathodes. Although any material with a sufficiently high electrical conductivity can be employed as a cathode, a most important index which characterizes the electrochemical activity of a given cathode material is the so-called "hydrogen overvoltage". The "hydrogen overvoltage" on a metal may be described by the constants a and b of the Tafel equation:

$$\eta = a + b \log i$$

where $\eta$ is the hydrogen overvoltage and i is the density of polarization current. It is well known that high hydrogen overvoltage metals include, for example, lead, thallium, zinc, mercury and cadmium; and that such high overvoltage metals retard the discharge of hydrogen ions on their surfaces, and for this reason organic compounds are not likely to be reduced by atomic hydrogen on such cathodic materials. Therefore, they can be reduced mainly by the electrochemical process proper, i.e., by direct electron transfer onto the molecule of the organic compound. For this reason, cathode surfaces of lead, thalium, zinc, mercury or cadmium are preferred for a great many electrochemical synthesis reactions involving reduction of compounds. An example of such an electrochemical reduction of organic compounds in an undivided cell is the reduction of acrylonitrile to adiponitrile, as taught in British Pat. No. 1,089,707 (to Tomilov). Wherever it is preferred in electrochemical synthesis to use cathodic surface metals selected for the particular process desired, for high or for low hydrogen overvoltage or for any other individual attribute or property, wherein at the same time, the metal is for one reason or another, not suitable for the construction of the entire electrode (usually because of the expense or the lack of strength of the material) it is a common practice to electroplate the desired metal on a more suitable metal such as steel which is strong, readily available and inexpensive. A suitable cathode for example, for the electrohydrodimerization of acrylonitrile to adiponitrile is cadmium-plated steel.

Electroplating of various metals by any of several methods including the cyanide or alkaline method, the acid sulfate method, the pyrophosphate method, the fluoborate method and the phytic (hexaphosphoric) acid method, is well known. All are described, for example, in U.S. Pat. No. 2,973,308.

Commercially, electrolytic cells for electrochemical synthesis are constructed of electrodes in permanently fixed and substantial parallel planar relationship. Metal-plated cathodes are typically electroplated from cadmium sacrificial anodes, water-rinsed, drained and sprayed with oil, crated for shipment and thereafter shipped to the user location where the crates are opened, unpacked, drilled for fastening and then assembled into electrode packages. The electrode packages, containing the plated cathodes are then made a part of the electrolytic cell. In the course of such production, it is not uncommon for the metal-plated cathode, to be marred, scratched, or coated with impurities deleterious to the electrochemical synthesis. For this reason, any method whereby handling of the metal-plated cathodes can be avoided without disproportionate cost increases or inconveniences would be a substantial advance in the art and such a method is an object of this invention.

The particular configuration of many electrode packages (including packages having bipolar interior electrodes such as are commonly employed commercially) in electrochemical synthesis, is such that only a portion of the metalic element known as the cathode is exposed to the electrolyte and actually participates in the electrochemical synthesis. For this reason, it is unnecessary, in the preparation of metal-plated cathodes, to metal plate the entire cathode element as is customarily done in prior art processes. Accordingly, a method whereby the metal-plating of cathodes can be restricted to those portions of the cathode which are actually exposed to the electrolyte would represent a substantial conservational achievement and a separate significant advance in the art, and such a method is another object of this invention.

In some electrochemical synthesis processes, it is desirable, from time to time to re-electroplate cathodes, and if such re-electroplating could be accomplished without disassembly of the electrode package and/or without removal of the package from the cell, a considerable amount of time and effort could be saved, such accomplishment being a third object of the invention.

SUMMARY OF THE INVENTION

According to this invention, electrode packages, for use in undivided electrolytic cells for electrochemical synthesis, which have, in permanently fixed and substantial parallel planar relationship, a plurality of electrodes comprising anoes and cathodes, a major portion of which cathodes are metal-plated, are prepared by assembling and permanently fixing the electrodes in the substantially parallel planar relationship as a package and thereafter electroplating the cathodes while in package form by applying an electric potential between the anodes and the cathodes, in an electroplating solution containing the plating metal in complex form, the anodes functioning as non-sacrificial anodes during electroplating. Preferably, the cell employed and means for applying a potential between the anodes and the cathodes in the electroplating step are the same cell and application means employed in the electrochemical synthesis.

THE DRAWING

In order to better understand the invention, reference will be made to the attached drawing in which.

DETAILED DESCRIPTION OF THE INVENTION

Figure 1:
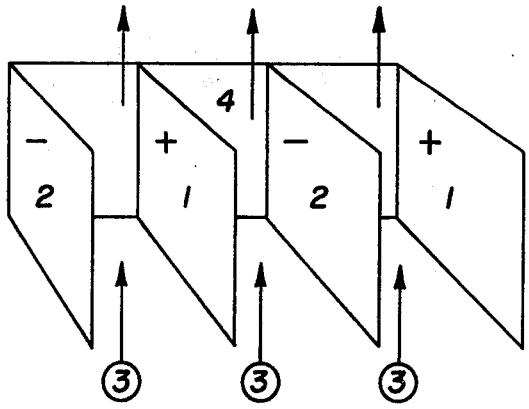
FIG. 1 illustrates diagrammatically in vertical section an arrangement of electrodes for electrochemical synthesis which can be assembled and electroplated in accordance with the instant invention.

The assembly of the electrode package is accomplished by any method known in the art not inconsistent by way of structure or material with the electrochemical synthesis to which the electrode package will be employed in the particular application. In many applications, it has been found expedient to place cathodes and anodes in extremely close parallel-planar relationship, and to plate but one side as the cathode in the manner depicted at FIG. 3. Critically spaced components of a unit such as that depicted in FIG. 3 may be held in spaced apart relationship, to the extent required in a particular configuration with plastic (polypropylene) spacers.

This invention contemplates the package electroplating of high hydrogen overvoltage metal and other metals on base metals. Generally, the plating of such metals on steel has been effected by methods known as the cyanide or alkaline method, the acid sulfate method, the pyrophosphate method and the fluoborate method as well as the phytic acid method, all of which are described in U.S. Pat. No. 2,973,308 (herewith incorporated by reference). A major requirement in the selection of a particular electroplating process to be practiced in accordance with the instant invention is that the plating solution contain the plating metal in complex form and that a potential be applied between the object to be plated (the cathode) and a non-sacrificial anode (preferably carbon steel). Any suitable electroplating process employing these principles is acceptable for the practice of this invention.

As is well known in the art, the employment of a reducing agent such as hydrazine minimizes the anodic oxidation of the metal complex agent, as taught in U.S. Pat. No. 3,770,596, (hereby incorporated by reference), and is preferred.

Due to the close relationship of the electrodes in the package described, it is most important that the electroplating be of a smooth and uniform consistency. Accordingly, a leveling agent of the polyether surfactant type is preferably employed. Polyether surfactants operable in the practice of this invention may include aromatic polyethers and aliphatic polyethers. Preferably the surfactant is a polyalkoxylated alkyl phenol. Typical polyalkoxylated alkyl phenols include polyethoxylated alkyl phenols having the formula:

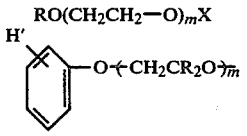

wherein R represents an alkyl group of from 4 to 18 carbon atoms, R' is an aliphatic radical containing 8 to 20 carbon atoms, m is an integer of at least 4 and no more than 100, and X is selected from the group consisting of hydrogen, $SO_3M$, and $PO_4M_2$ where M is selected from the group consisting of sodium, potassium, ammonium, magnesium, lead, tin, calcium, rubidium, cesium, or any other bath-compatible cation. Operable polyether surfactants include nitrogen-containing aliphatic polyethers characterized by the following general formula:

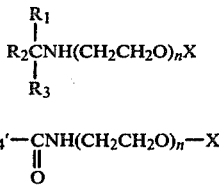

wherein $R_1$, $R_2$, $R_3$ and $R_4$ represent a straight or branched chain alkyl group exhibiting 8 to 18 carbon atoms, n is an integer of at least 4 and no more than 100, and X is selected from the group consisting of hydrogen, $SO_3M$, $PO_4M_2$ where M is selected from the group consisting of sodium, potassium, ammonium, magnesium, lead, tin, calcium, rubidium, cesium, or any other bath-compatible cation. Polyether surfactants are employed singly in amounts of about 1 g./l. to 10 g./l., and in combination from 10 g./l. to 20 g./l. Typical specific compounds are the following with their concentration ranges varying singly from 1 g./l. to 10 g./l. and in combination from 10 g./l. to 20 g./l.:

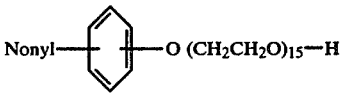

(sold as Tergitol Non-Ionic NP-35)

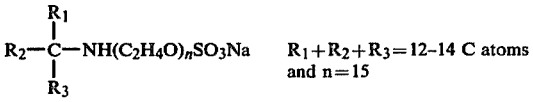

(Sold as Triton QS-15)

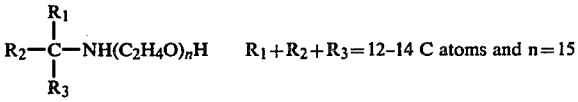

(sold as Priminox R-15)

Where the cathode is to be cadimum plated, cadmium complexing agents as, for example, cyanide (CN-) and ethylenediaminetetraacetate (EDTA) have been found satisfactory. Where EDTA has been employed, a greater variety of levelers, including hexadecyl trimethylammoniumhydroxyde (C16 TMAOH) as well as a polyether surfactant has been found suitable as a leveling agent. As stated above, the only source of the metal to be plated upon the cathode is in the plating solution. The plating solution may be of decreasing concentration of the cadmium complex or the concentration may be fixed by reconstituting the solution on a cycle employing methods well known in the electroplating art.

The substrate of the metal-plated cathode (and anode surface) preferably consists essentially of carbon steel as opposed as to iron, alloy steel or stainless steel. Carbon steel, as defined herein (and by the American Iron and Steel Institute [AIS]) is as follows: "carbon steel is classed as such when no minimum content is specified or guaranteed for aluminum, chromium, columbium, molybdenum, nickel, titanium, tungsten, vandadium or zirconium; when the minimum for copper does not exceed 0.40 percent; or when the maximum content specified or guaranteed for any of the following elements does not exceed the percentages noted: maganese 1.65; silicon 0.60, copper 0.60." Carbon steels of various compositions are listed in the 1000, 1100 and 1200 series of AISI and SAE standard steel composition numbers, many of which may be found on page 62 of Volume 1, Metals Handbook, 8th Edition (1961) published by the American Society for Metals, Metals Park, Ohio. Carbon steels are readily distinguishable from steels conventionally known as alloy steels and listed in the 1300 and higher series of the aforementioned standard steel composition numbers, from the special alloy steels that are conventionally known as stainless steels and normally contain substantial (usually more than 0.5%) other metals such as nickel and/or chromium, and from commercially-pure iron which, by definition, contains not more than 0.01% carbon. In general, the carbon steels that are preferably used as anode materials in the process of this invention contain between about 0.02% carbon (more typically at least about 0.05% carbon) and about 2% carbon. Normally, carbon steels such as those of the AISI and SAE 1000 series of standard steel composition numbers are preferred and those containing between about 0.1% and about 1.5% carbon are typically most desirable. Only a small amount of dissolution of a carbon steel anode takes place while electroplating and a soluble iron content slowly builds up in the plating solution.

One of the desirable characteristics of a cathode to be employed in electrochemical synthesis is smoothness. Smoothness may be measured in terms of Centerline Average (CLA) which, as used herein is determined in accordance with the definition of Centerline Average set forth in American Standard ASA B46.1-1962 (Surface Texture) published by The American Society of Mechanical Engineers, 345 East 47th Street, New York, N.Y. In most cases, the Centerline Average of the cathodic surface employed for electrochemical synthesis is desirably less than about 70 microinches (1.78 microns), preferably less than about 50 microinches (1.27 microns) and, for superior results in many cases, less than about 30 microinches (0.76 microns).

After electroplating, if appropriate, the power supply should be discontinued and the used plating solution circulated through the cell for an additional period of time before being drained from the cell. As disclosed in a prospectively copending U.S. patent application, the rinsing of cathodes, particularly cadmium plated cathodes with the electroplating solution has been found to inhibit fouling of the cathode in certain electrochemical synthesis processes such as the electrohydrodimerization of acrylonitrile to adiponitrile.

Referring now to the drawing, FIG. 1 shows an arrangement of substantially parallel planar fixed electrodes which is suitable for electrochemical synthesis and for electroplating in accordance with this invention. The electrodes are anodes (1) and cathodes (2) which are held in fixed parallel planar relationship by non-conductive backing (4). An electroplating solution (3) passes between anodes (1) and cathodes (2).

Figure 2:
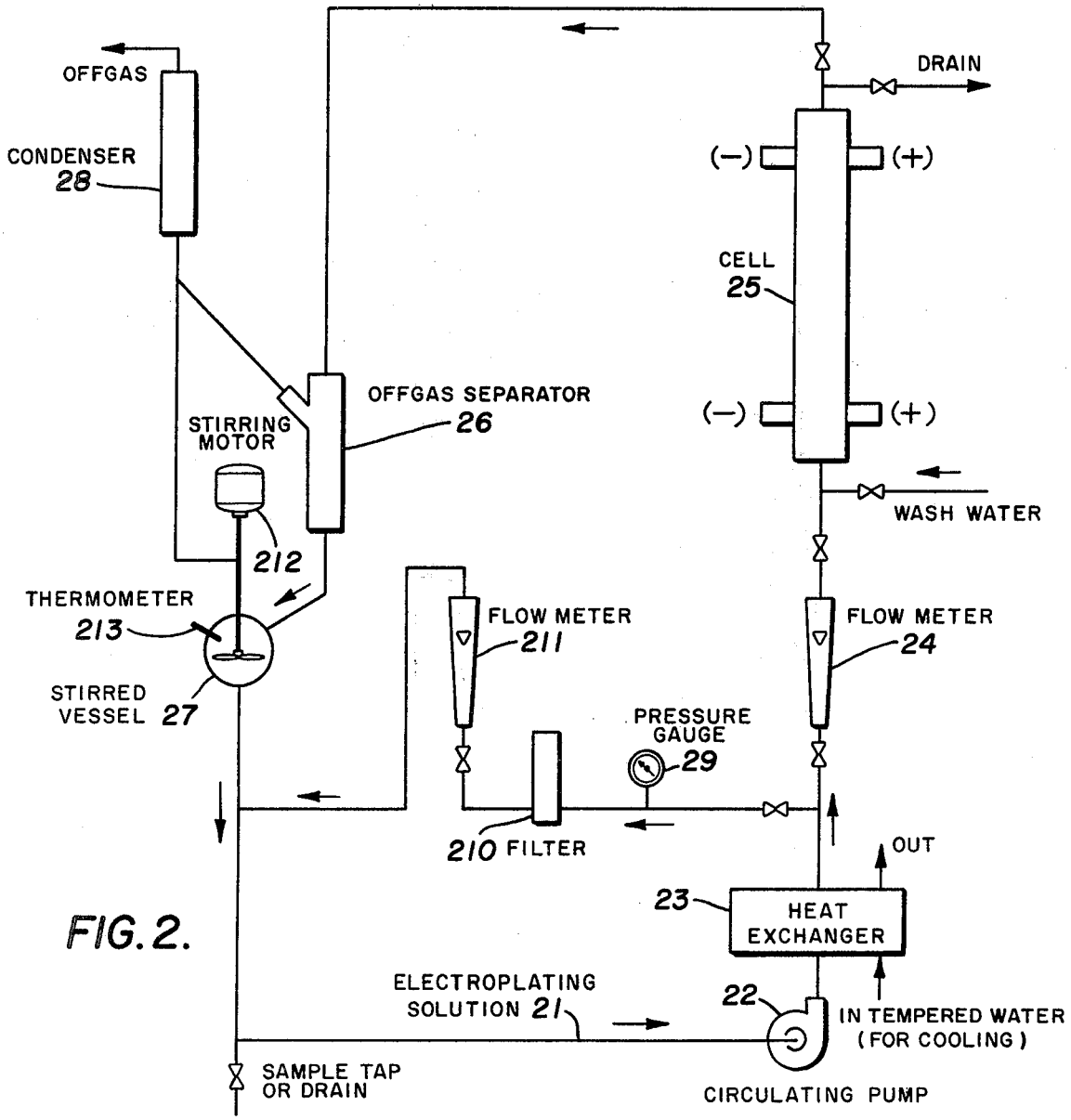
FIG. 2 is a schematic diagram of an apparatus for electrochemical synthesis.

Referring now in detail to FIG. 2, electroplating solution (21), containing the cadmium complex, leveling agent and anode depolarizer is pumped by means of circulating pump (22) through heat exchanger (23) and flow meter (24) to cell (25) where electroplating takes place. Passing through cell (25), the solution is pumped to off-gas separator (26) where most of the off-gas is separated from the liquid which drains into stirred vessel (27). The gas itself is passed to condenser (28) for removal of condensable material. Between heat exchanger (23) and flow meter (24) is a filtration stream comprising pressure gauge (29) filter (210) and flow meter (211). Stirring motor (212) and thermometer (213) are included in stirred vessel (27).

Figure 3:
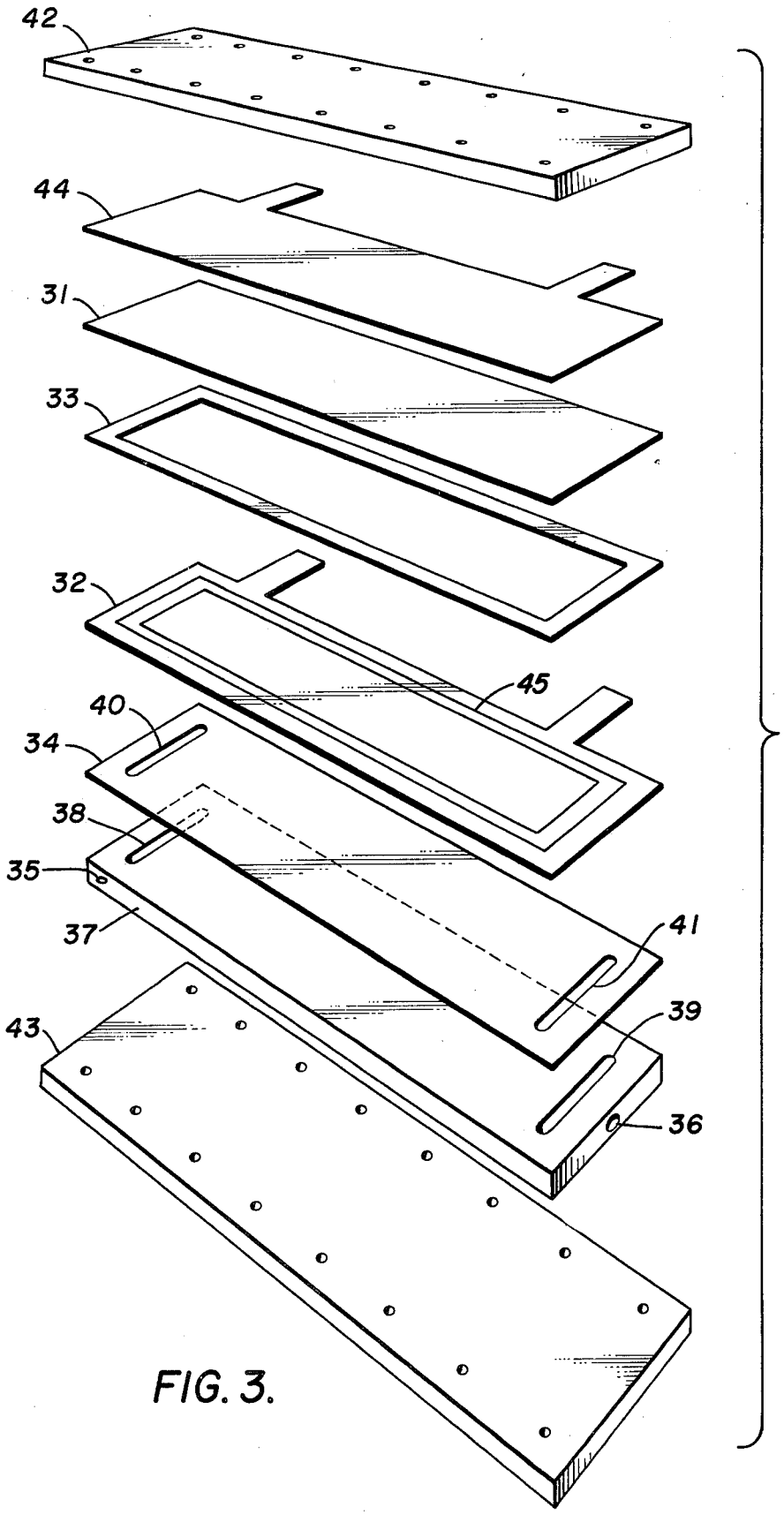
FIG. 3 is an exploded assembly of an experimental electrode package of a type which may be assembled and electroplated according to this invention.

Referring now in detail to FIG. 3, the essential portions of the simplified cell are cathode (31) and anode (32), which are separated by plastic spacer (45). A circulation chamber is defined by cathode (31), anode (32) and the inside perimeter of plastic spacer (45). The electroplating solution is fed through aperture (36) and slot (39) of polyethylene feed block (37) through slot (41) of neoprene gasket (34) to the aforementioned circulation chamber, and from the circulation chamber through slot (40) of neoprene bottom gasket (34), slot (38) of polyethylene feed block (37), and out through aperture (35) of polyethylene feed block (37). The entire assembly, including micarta upper and lower plates (42) and (43) and conductor plate (44) is assembled in fixed parallel-planar relationship. Plastic spacer (45) on anode (32) assures uniform spacing of the element from cathode (31). Spacer (45), in this particular embodiment is 0.178 cm thick.

EXAMPLES

Example 1

A 1500 ml plating solution containing 32.0 g. $Cd^{++}$/0.4 g polyethylene glycol (PEG) equal parts number average molecular weight (MW) 1000/1450/per liter with a $CN^-/Cd^{++}$ mole ratio of 8 at pH 12.5 was circulated at one foot/second and 30° C. through the cell depicted in FIG. 3 at a current density (CD) of 0.0084 amp/cm$^2$ for 300 minutes. The 20.4 g Cd deposited on the 230 cm$^2$ cathode represents a 100% cathode current efficiency and had an average 3.5±0.1 mil plate thickness with centerline averages (CLA's) of 18–19 microinches and the 0.22 moles $CN^-$/F lost shows the amount of $CN^-$ that is lost in the absence of hydrazine.

Example 2

A 1500 ml plating solution containing 68.5 g $Cd^{++}$/0.31 moles $H_2NNH_2$/0.4 g PEGs (equal parts MW 1000 and 1450)/per liter with a $CN^-/CD^{++}$ mole ratio=4 at ph=12.30 was circulated at one foot/second and 30° C. through the cell at a CD=0.008 amp/cm$^2$ for 300 minutes. The 34.7 g Cd deposited on the 416 cm$^2$ cathode area represents a 100% cathode current efficiency and had a 3.72±0.18 mil average plate thickness with CLA's of 40–58. The plating solution increased by 4 ppm Fe and the current efficiency for anoidcally oxidizing $H_2NNH_2$ was 97%.

Example 3

A 1500 ml plating solution containing 67.8 g $Cd^{++}$/0.4 g PEG (equal parts MW 1000 and 1450)/0.30 moles $H_2NNH_2$/per liter with a $CN^-/Cd^{++}$ mole ratio=4 at pH=12.63 was circulated at one foot/second and 30° C. through the cell at a CD (Current Density)=0.01 amp/cm$^2$ for 240 minutes. The 36.6 g Cd deposited on the 416 cm$^2$ cathode area represents a 100% cathode current efficiency and had a 3.89±0.11 mil average plate thickness with CLA's of 60–91. The current efficiency for anodically oxidizing $H_2NNH_2$ was 95.6% and the plating solution increased by 3 ppm Fe. This cathode was run over 192 hours in an electrolysis cell and its cathode gave normal ADN yields and showed no signs of fouling.

Example 4

A 1500 ml plating solution containing 67.4 g $Cd^{++}$/0.4 g PEG (equal parts MW 1000 and 1450)/0.30 moles $H_2NNH_2$/per liter with a $CN^-/Cd^{++}$ mole ratio=4 at pH=11.80 was circulated at one foot/second and 50° C. through the cell at a CD=0.01 amp/cm$^2$ for 240 minutes. The 36.7 g Cd deposited on the 416 cm$^2$ cathode represents a 101% cathode current efficiency and had a 3.92±0.12 mil plating thickness with CLA's of 26–42. The current efficiency for anodically oxidizing $H_2NNH_2$ was 101% and the plating solution increased by 3 ppm Fe.

Example 5

A 1500 ml plating solution containing 64.1 g $Cd^{++}$/0.4 g PEG (equal parts MW 1000 and 1450)/0.31 moles $H_2NNH_2$/per liter with a $CN^-/Cd^{++}$ mole ratio=8 at pH=11.79 was circulated at one foot/second and 30° C. through the cell at CD=0.01 amp/cm$^2$ for 242 minutes. The 36.8 g Cd deposited on the 416 cm$^2$ cathode area represents a 101% cathode current efficiency and had a 3.81±0.19 mil average plate thickness with CLA's of 9–18. The plating solution increased by 4 ppm Fe and the current efficiency for anodically oxidizing $H_2NNH_2$ was 97.5%. An average of 0.007 moles $CN^-$/Faraday was lost in this series of plating fourteen cathodes which shows that less $CN^-$ is lost in the presence of hydrazine. No HCN was detected in the offgas.

EXAMPLE 6

A 1500 ml plating solution containing 45.7 g $Cd^{++}$/0.4 g PEG (equal parts MW 1000 and 1450)/3600 ppm $Fe^{+++}$ (added as $K_3Fe(CN)_6$)/per liter with $CN^-/Cd^{++}$ mole ratio=8 at pH=12.67 was circulated at one foot/second and 30° C. through the cell at a CD=0.008 amp/cm$^2$ for 300 minutes. The 34.5 g Cd deposited on the 416 cm$^2$ cathode area represents a 94% cathode current efficiency and had 3.75±0.15 mil plating thickness with CLA's of 6–9. A sample of the cadmium plating (3.75 mils thick) was dissolved in nitric acid and less than 40 ppm Fe was found in the plate. The cathode was run over 268 hours in an electrolysis cell producing good ADN yields and showed no signs of fouling which shows that a satisfactory cadmium cathode can be plated in the in the presence of high $Fe^{+++}$ concentrations.

Example 7

A 1500 ml plating solution containing 47.5 g $Cd^{++}$/0.4 g PEG (equal parts MW 1000 and 1450)/per liter with ethylenediaminetetraacetate (EDTA)/$Cd^{++}$ mole ratio=1.5 at pH 8.1 was circulated at one foot/second and 30° C. through the cell at a CD=0.008 amp/cm$^2$ for 300 minutes. The 12.5 g Cd on the 230 cm$^2$ cathode area represents a 65% cathode current efficiency and had 2.64±0.06 mil plating thickness with a CLA of 14. The iron content of the plating solution increased 22 mmp and 0.148 moles EDTA/faraday was lost during electrolysis which shows the amount of EDTA lost in the absence of hydrazine.

Example 8

A 1500 ml plating solution containing 67.4 g $Cd^{++}$/no leveling agent and no $H_2NNH_2$ added/per liter with a EDTA/$Cd^{++}$ mole ratio=1.67 at pH=12.8 was circulated at one foot/second and 30° C. through the cell at a CD=0.008 amp/cm$^2$ for 300 minutes. The 35.1 g Cd on the 416 cm$^2$ cathode area represents a 101.4% cathode current efficiency but the surface was heavily ridged. The iron content of the plating solution increased by 1 ppm and 0.14 moles EDTA/-Faraday was lost during electrolysis which shows the amount of EDTA lost in the absence of hydrazine, and shows how rough the surface becomes without a leveling agent being present.

Example 9

A 1500 ml plating solution containing 60.0 g $Cd^{++}$/2.0 g $C_{16}TMAOH$/0.30 moles $H_2NNH_2$/per liter with a EDTA $Cd^{++}$ mole ratio=1.12 at pH=12.50 was circulated at one foot/second and 30° C. through the cell at a CD=0.008 amp/cm$^2$ for 300 minutes. The 34.5 g Cd on the 416 cm$^2$ cathode area represents a 99.7% cathode current efficiency and had 4.10±0.20 mil plating thickness with CLA's of 40–43. The iron content of the plating solution increased 1 ppm and the 0.03 moles EDTA/faraday lost during electrolysis shows that smaller amounts of EDTA are lost in the presence of hydrazine.

Example 10

A 1500 ml plating solution containing 30.3 g $Cd^{++}$/0.2 g $C_{16}TMAOH$/0.30 moles $H_2NNH_2$/per liter with a EDTA/$Cd^{++}$ mole ratio=1.5 was circulated at one foot/second and 30° C. through the cell at CD=0.008 amp/cm$^2$ for 261 minutes. The 30.3 g Cd deposited on the 416 cm$^2$ cathode area represents a 100.0% cathode current efficiency and had a 3.32 mil plating thickness with CLA's of 86 to 115. The iron content of the plating solution increased by 1 ppm; the current efficiency for anodically oxidizing $H_2NNH_2$ was 100.0% and the 0.011 moles EDTA/faraday lost during electrolysis shows that smaller amounts of EDTA are lost when hydrazine is present.

Example 11

A 1500 ml plating solution containing 60.0 g $Cd^{++}$/−1.0 g PEG's (equal parts MW 1000 and 1450)/0.45 moles $H_2NNH_2$/per liter with an EDTA/$Cd^{++}$ mole ratio=2.1 at pH=11.7 was circulated at two feet/second and 40° C. through the cell at a CD=0.012 amp/cm$^2$ for 104 minutes. The 18.6 g Cd on the 416 cm$^2$ cathode area represents a 102% cathode current efficiency which characterizes the high efficiency to be expected when using solutions of pH≧11.7. The 1.92±0.08 mil plating thickness had CLA's of 12–19 microinches.

Example 12

A 1500 ml plating solution containing 40 g $Cd^{++}$/1.0 g PEG's (equal parts MW 1000 and 1450)/0.45 moles $H_2NNH_2$/per liter with an EDTA/$Cd^{++}$ mole ratio=2.1 at pH 11.0 was circulated at one foot/second and 40° C. through the cell at a CD=0.016 amp/cm$^2$ for 78.5 minutes. The 14.0 g Cd on the 416 cm$^2$ cathode area represents only a 76.5% cathode current efficiency which shows how the current efficiency can be decreased by operating with a solution of pH less than 11.7. The 1.75±0.10 mil plating thickness had CLA's of 59–96 microinches which reflects the roughing of the surface as the current density is increased.

In-plate plating of multi-electrode cell packages comprising "bi-electrodes" (having a carbon steel side as the anode for one-cell and a plated side which is the cathode for the adjacent cell and having no independent source of electrical potential as by independent electrical current) may be accomplished in the same manner as depicted in the drawing, and explained herein. It should be pointed out however that a variance will inevitability occur in the plating thickness between the plated cathode surfaces of interior bipolar and exterior plates of the package. Such variances are believed to be consistent with good performance and long life in where subsequent electrochemical synthesis the commercial packages contain as many as 200 plates.

We claim:

1. In a method for production of an undivided electrolytic cell for electrochemical reduction of organic compounds having in permanently fixed and substantially parallel planar relationship electrodes comprising anodes and cathodes at least a portion of which cathodes are metal-plated the metal plating constituting the cathode surface wherein cathode substrates are electroplated and thereafter assembled and permanently fixed in said substantially parallel planar relationship, the improvement comprising assembling the anodes and cathode substrates in said substantially parallel planar relationship as a package and thereafter electroplating the cathode substrates while in package form by applying an electric potential between said anodes and cathode substrates in an electroplating solution containing the plating metal in complex form, said anodes functioning as nonsacrificial anodes during electroplating.

2. The method of claim 1 wherein the cathodes are electroplated in a cell otherwise employed for electrochemical synthesis.

3. The method improvement of claim 2 wherein means for applying a potential between said anodes and said cathodes of said electrolytic cell for electrochemical synthesis and the means for applying a potential between the anodes and the cathodes in the electroplating step are the same.

4. The method improvement of claim 1 wherein the cathodes are cadmium-plated steel.

5. The method improvement of claim 1 wherein the anode is carbon steel.

6. The method improvement of claim 1 wherein the cathode is cadmium-plated carbon steel and the anode is unplated carbon steel.

7. The method improvement of claim 1 wherein the electrolyte in the electroplating step includes a polyether surfactant.

8. The method improvement of claim 1 wherein the electrolyte includes hydrazine.

9. The method improvement of claim 1 wherein the electrolyte includes a polyether surfactant and hydrazine.

10. The method improvement of claim 1 wherein the electrolyte includes a complexing agent selected from the group consisting of cyanide and ethylenediaminetetraacetate, a polyether surfactant and hydrazine.

11. The method improvement of claim 1 wherein interior electrodes are bi-polar plates comprising a cathode surface and an anode surface.

12. The method improvement of claim 11 wherein the cathode surface is cadmium and the anode surface is carbon steel.

* * * * *